US010617187B2

(12) United States Patent
Marvin et al.

(10) Patent No.: US 10,617,187 B2
(45) **Date of Patent: *Apr. 14, 2020**

(54) CARD HOLDER EMBEDDED INTO A MOBILE DEVICE CASE

(71) Applicant: Slide and Swipe, LLC, Kirkland, WA (US)

(72) Inventors: Jacob James Marvin, Kirkland, WA (US); Thomas Kirk Marvin, Bellevue, WA (US); Matthew Laurence Arksey, Seattle, WA (US); Scott Robert Leatham, Redmond, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/870,295

(22) Filed: Jan. 12, 2018

(65) Prior Publication Data

US 2018/0132585 A1 May 17, 2018

Related U.S. Application Data

(62) Division of application No. 14/599,148, filed on Jan. 16, 2015, now Pat. No. 9,901,151.

(51) Int. Cl.

| | |
|---|---|
| ***B65D 69/00*** | (2006.01) |
| ***B65D 71/00*** | (2006.01) |
| ***A45C 11/00*** | (2006.01) |
| ***A45C 11/18*** | (2006.01) |
| *A45C 15/00* | (2006.01) |

(52) U.S. Cl.

CPC ..... *A45C 11/00* (2013.01); *A45C 11/182* (2013.01); *A45C 15/00* (2013.01); *A45C 2011/002* (2013.01)

(58) Field of Classification Search

CPC . A45C 11/00; A45C 11/182; A45C 2011/002; A45C 15/00

USPC ... 206/320, 38, 39, 232, 37, 37.4, 39.4, 39.5

See application file for complete search history.

(56) References Cited

U.S. PATENT DOCUMENTS

| | | | | |
|---|---|---|---|---|
| 4,518,080 | A * | 5/1985 | Ohlson | A45C 11/182 206/37 |
| 4,768,648 | A | 9/1988 | Glass | |
| 5,992,618 | A * | 11/1999 | Joh | A45C 11/18 206/38 |
| 6,026,873 | A | 2/2000 | Van Geer | |
| 6,164,442 | A | 12/2000 | Stravitz | |
| 6,341,693 | B2 | 1/2002 | Konno et al. | |
| 6,533,118 | B1 | 3/2003 | Nelson | |
| 8,047,364 | B2 * | 11/2011 | Longinotti-Buitoni | A45C 11/00 206/320 |
| 9,049,283 | B1 * | 6/2015 | Kim | H04M 1/21 |
| 2007/0057004 | A1 * | 3/2007 | Butler | A45C 11/182 224/669 |

(Continued)

*Primary Examiner* — Rafael A Ortiz

(57) ABSTRACT

An improved mobile device case with an embedded card holder is provided. The mobile device case may include a card slot recessed into the back of the case and fitted for insertion of a card, such as a credit card. A flexural binder formed from opposite-facing surfaces molded as part of the case flexes the card widthwise and lengthwise such that the forces resisting flexure exerted by the flexed card hold the card in place. One opposite-facing surface, a retainer, may be connected to non-recessed areas of the back of the case that extends over the recessed slot. Another opposite-facing surface is a raised edge on the recessed surface of the interior back of the case bordering both sides and the rear of the recessed slot.

10 Claims, 7 Drawing Sheets

(56) References Cited

U.S. PATENT DOCUMENTS

| | | | | |
|---|---|---|---|---|
| 2009/0101255 | A1* | 4/2009 | Long | A45C 11/182<br>150/147 |
| 2010/0038000 | A1* | 2/2010 | Ho | A45C 11/182<br>150/147 |
| 2010/0224519 | A1* | 9/2010 | Kao | A45C 11/00<br>206/320 |
| 2012/0067751 | A1* | 3/2012 | Mongan | A45C 11/00<br>206/216 |
| 2014/0251368 | A1* | 9/2014 | Lawson | A45C 11/00<br>132/287 |
| 2016/0014922 | A1* | 1/2016 | Banerjee | A45C 7/0031<br>206/38 |

* cited by examiner

CARD HOLDER EMBEDDED INTO A MOBILE DEVICE CASE

FIELD OF THE INVENTION

The invention relates generally to mobile device case, and more particularly to a card holder embedded into a mobile device case.

BACKGROUND OF THE INVENTION

Mobile phone adoption continues unabated worldwide. Many mobile smartphone users purchase cases for their smartphones for a variety of reasons. Some purchase smartphone cases to protect their mobile smartphone from incidental scratches. Others purchase smartphone cases to protect their mobile smartphone from impact damage by dropping the smartphone. Still others purchase water resistant smartphone cases to protect their smartphone from water damage. Those concerned with privacy may purchase smartphone cases to protect their phone from Radio Frequency Identification ("RFID") intrusion. And yet others purchase smartphone cases to hold an object, such as a business card or other type of card, in addition to the smartphone.

Typically, mobile device cases that hold a card in addition to a mobile device provide a separate compartment to hold cards. Some such mobile device cases are manufactured using plastic injection molding in the current state of the art. A molded case that provides a separate compartment to hold cards is known in the art but has several drawbacks. The separate compartment has a door or drawer that needs to be opened and closed each time a card is inserted or removed, and the separate compartment adds bulk to the mobile device case. A molded case that provides a separate fitted cavity is also known in the art which utilizes a flexible layer of material between an encased mobile device and the separate fitted cavity that holds inserted cards. To prevent the inadvertent loss of inserted cards, the flexible layer of material of the separate fitted cavity may add pressure or a static frictional force between itself and inserted cards. Although functional, the static frictional force makes it cumbersome to remove an inserted credit card, and the separate fitted cavity adds bulk to the mobile device case. Another molded case that is a multi-piece case with a cavity rather than a separate compartment for inserting a credit card is additionally known in the art but has several drawbacks. There is no protection between the back of an enclosed phone and an inserted card, so a mobile device may be scratched when a credit card is inserted into and removed from the slot. Furthermore, there is nothing that prevents an inserted credit card from inadvertently falling out of the case.

SUMMARY OF THE INVENTION

Briefly, the present invention may provide a mobile device case with an embedded card holder. In an embodiment, the mobile device case may be a one-piece case that includes a card slot recessed into the back of the case with an area in the card slot fitted for insertion of a card, such as a credit card. In various embodiments, the invention may conveniently carry a credit card, a proximity card, a smart card, a business card, an identification card, or other card. The case may include an opening on the side of the case for sliding the card into the card slot recessed into the back of the case. The opening to the recessed slot on the side of the case may continue around the corner of the case and extend over the recessed area of the back of the case for access to manually slide the card out of the card slot.

A retainer may be connected to non-recessed areas of the back of the case that extends over the recessed slot to secure and facilitate movement of a card in the recessed slot. Rails may protrude from the retainer against which a card may slide during insertion into and removal from the card slot. In an embodiment, the retainer may have a hole or an opening in it into which a card may be flexed when manually depressed from the back of the recessed slot, for example by the thumb of a hand, to move or remove the card from the recessed slot. Additionally, there may be a raised edge on the recessed surface of the interior back of the case bordering both sides and the rear of the recessed slot. When a card is inserted into the recessed slot, the card may glide on the rails molded as part of the retainer while the opposite side of the card may slide at each widthwise edge on the raised edges molded on the interior back of the case bordering each side of the recessed slot. The height of the rails molded as part of the retainer may be sufficient to slightly bend the card lengthwise as the opposite widthwise sides of the card presses against the raised edges molded on the interior back of the case bordering each side of the recessed slot. As the card is further inserted into the recessed slot, the center of the card may bend upward away from the retainer such that it may impinge upon the raised edges on the recessed surface of the interior back of the case bordering the rear of the recessed slot. Thus the card bends lengthwise as it is inserted into the slot, impinges upon the raised edge bordering the rear of the recessed slot, then further bends widthwise to wedge under the raised edge bordering the rear of the recessed slot until it hits the back side of the slot upon complete insertion. Accordingly, the card is held in place by a flexural binder that flexes the card widthwise and lengthwise such that the forces resisting flexure exerted by the flexed card hold the card in place and secure the card from falling out of the recessed slot.

When a card being inserted into the slot impinges against the raised edge bordering the rear of the recessed slot, an audible click may be generated as the card may snap above that raised edge and is fully inserted into the recessed slot. In addition, tactile feedback may be felt both when a card being inserted into the recessed slot impinges against that raised edge and also when the card hits the back side of the recessed slot upon complete insertion. Advantageously, the audible click and tactile feedback each provide confirmation to the person who inserted the card into the card holder that the card is fully seated and secured in slot.

In yet another embodiment, one or more detents may be molded as part of a surface of the case and positioned between at the opening to the recessed slot on the side of the case and in front of the area in the card slot fitted for insertion of the card. A card fully inserted in the recessed slot may abut each detent in order to secure a card fully inserted in the recessed slot from inadvertently falling out of the case.

Other advantages will become apparent from the following detailed description when taken in conjunction with the drawings, in which:

DETAILED DESCRIPTION

The present invention is generally directed towards a case for a mobile device, such as a phone, with a card holder embedded into the mobile device case. More particularly, the card holder embedded into the mobile device case may include a card slot recessed into the back of the case and fitted for insertion of a card, such as a credit card. To prevent an inserted card from inadvertently falling out of the case, a flexural binder formed from opposite-facing surfaces molded as part of the case flexes the card widthwise and lengthwise such that the forces resisting flexure exerted by the flexed card hold the card in place. One opposite-facing surface, a retainer, may be connected to non-recessed areas of the back of the case that extends over the recessed slot to secure and facilitate movement of a card in the recessed slot. Rails may protrude from the retainer against which a card may slide during insertion into and removal from the card slot. The retainer may also protect the back of an enclosed mobile device from being scratched when a credit card is inserted into and removed from the card slot. Another opposite-facing surface is a raised edge on the recessed surface of the interior back of the case bordering both sides and the rear of the recessed slot. When a card is inserted into the recessed slot, the card may glide on the rails molded as part of the retainer while the opposite side of the card may slide at each widthwise edge on the raised edges molded on the interior back of the case bordering each side of the recessed slot.

As will be seen, the invention may conveniently carry a credit card, a proximity card, a smart card, a business card, an identification card, or other card that may have a magnetic stripe, radio frequency identification or other communication interface for reading or transmitting information stored on the card such as financial, identification, medical or other data. As will be understood, the various figures and scenarios described herein are only examples, and there are many other scenarios to which the present invention will apply.

Figure 1:
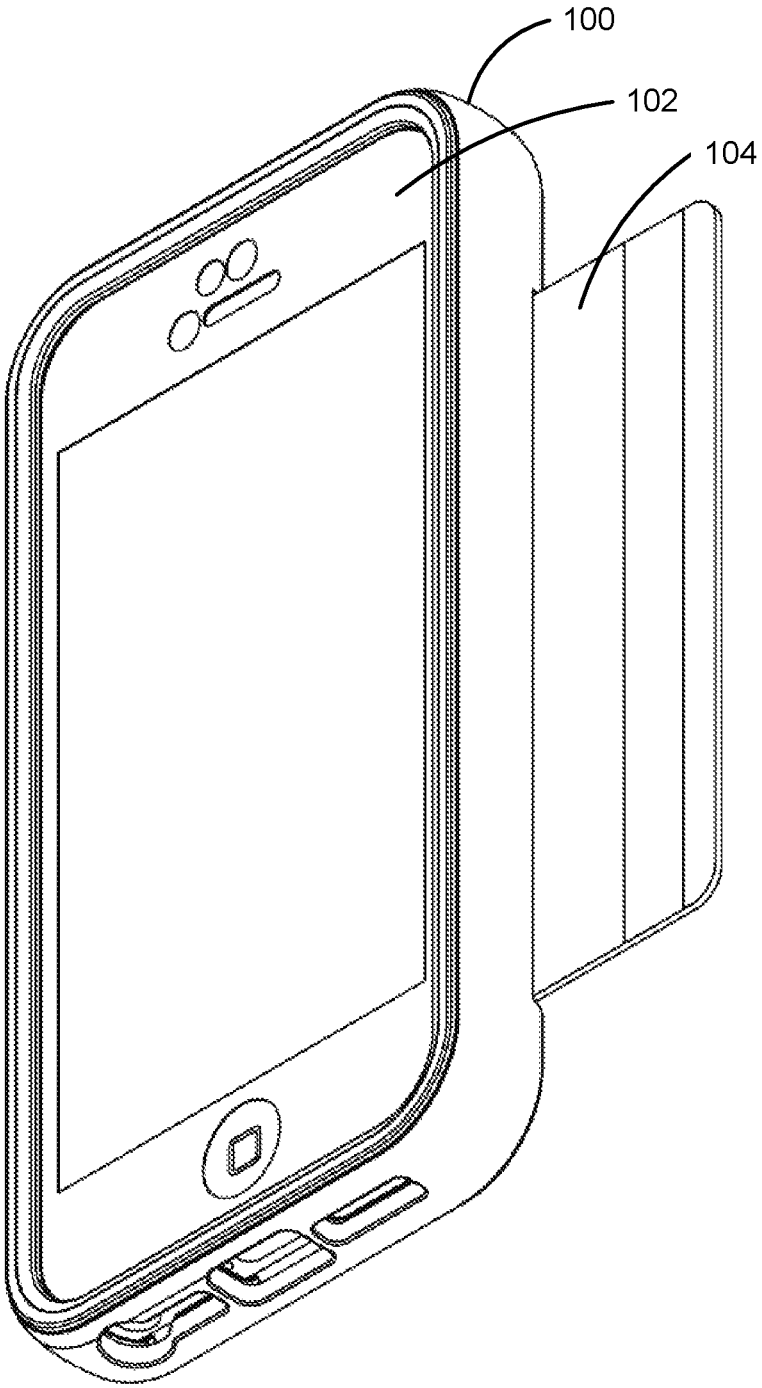
FIG. 1 is a front perspective view of a mobile phone case in an embodiment with an embedded card holder and a credit card extending from a card holder, in accordance with an aspect of the present invention.

Turning to FIG. 1 of the drawings, there is shown a front perspective view of a mobile phone case in an embodiment with an embedded card holder and a credit card extending from a card holder. The mobile phone case 100 illustrated in FIG. 1 may enclose a mobile phone 102, and embedded in the back of the case may be a recessed card holder that may hold a card, such as the credit card 104 shown extended from the card holder. The mobile phone case may be manufactured from plastic as a one-piece case using plastic injection molding. Alternatively, the mobile phone case may be fabricated from metal, a rigid rubber material, a polycarbonate material, or other suitable material and/or some combination thereof. The mobile phone case may be any color or texture. Generally, the card holder embedded in the back of the case is easily accessed for inserting, storing, withdrawing, extending or retracting a card. For example, a card may be conveniently extended, but not removed, using the thumb or fingers of a single hand holding the phone for swiping in a point of sale card reader. And the card may be easily retracted using the thumb or fingers of a single hand holding the phone until fully reinserted into the card holder.

Figure 2:
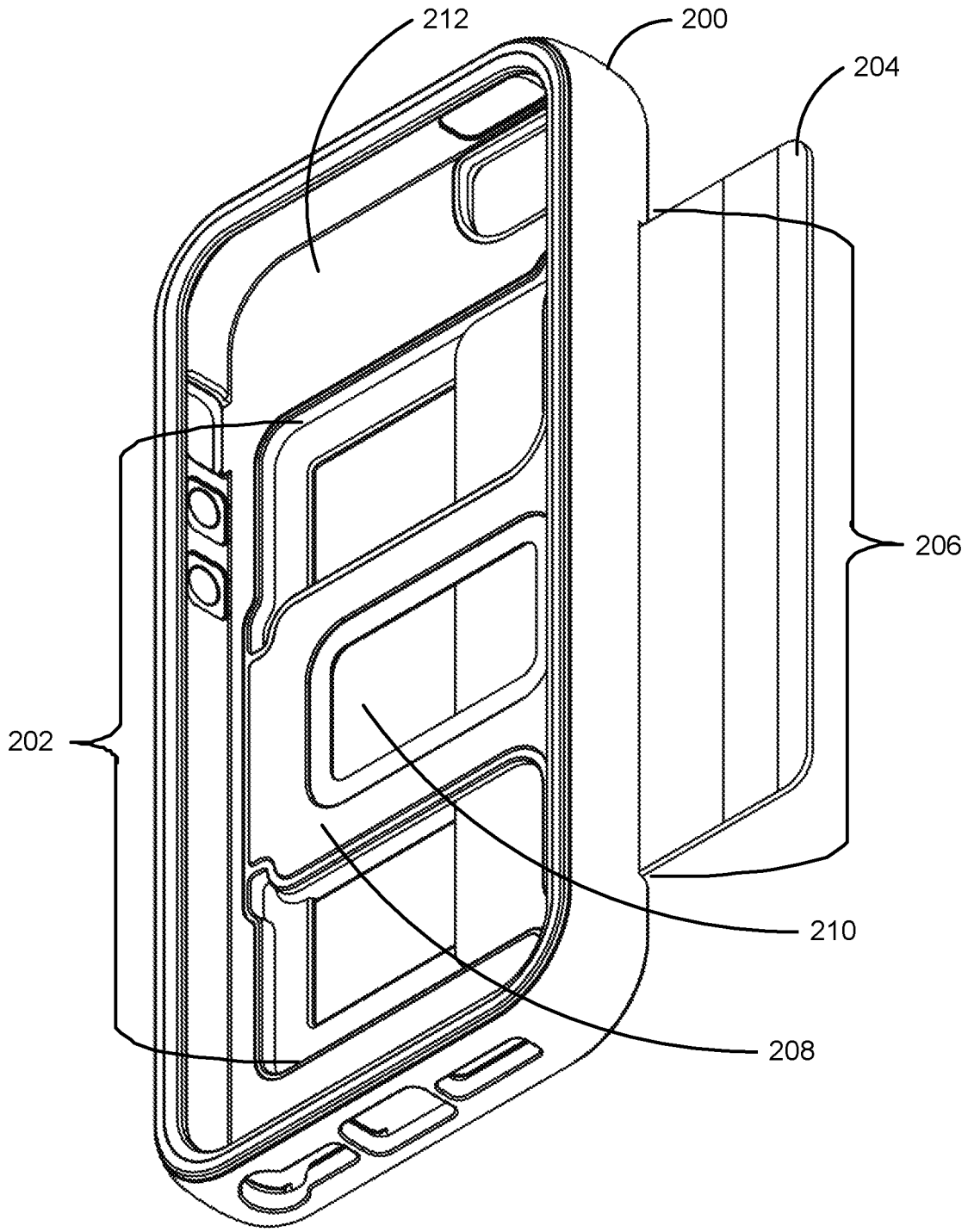
FIG. 2 is a front perspective view of a mobile phone case in an embodiment shown without an enclosed phone and with a credit card extending from a card holder embedded in the back of the mobile phone case, in accordance with an aspect of the present invention.

FIG. 2 presents a front perspective view of a mobile phone case in an embodiment shown without an enclosed phone and with a credit card extending from a card holder embedded in the back of the mobile phone case. The card holder embedded into the back of the mobile phone case 200 includes a slot 202 recessed in the back of the case 200 for holding the card 204, an opening 206 to the recessed slot 202 on the side of the case for sliding a card 204 into the recessed slot 202, a retainer 208 extending over the recessed slot 202 against which a card 204 may slide as it is inserted into the recessed slot 202. Note that, in an embodiment, the retainer may have a hole 210 or an opening in it as shown in FIG. 2 into which a card 204 inserted into the recessed slot 202 may be flexed down when manually depressed from the back of the recessed slot, for example by the thumb of a hand. When so flexed down, the forces resisting flexure exerted by the flexed card may be reduced, thereby enabling the card to more easily slide in the recessed slot due to the reduced flexure of the card in the recessed slot. A card inserted into the recessed slot may be partially extended using the thumb of a hand holding the phone for swiping in a point of sale card reader. The back of a phone enclosed in the case may also rest on the front of the retainer in addition to resting on the non-recessed areas 212 of the interior back of the case. In various embodiments the retainer may be connected to the non-recessed areas of the back of the case as shown in FIG. 2. Furthermore, a plastic liner may be molded on the non-recessed areas of the interior back of the case.

Figure 3:
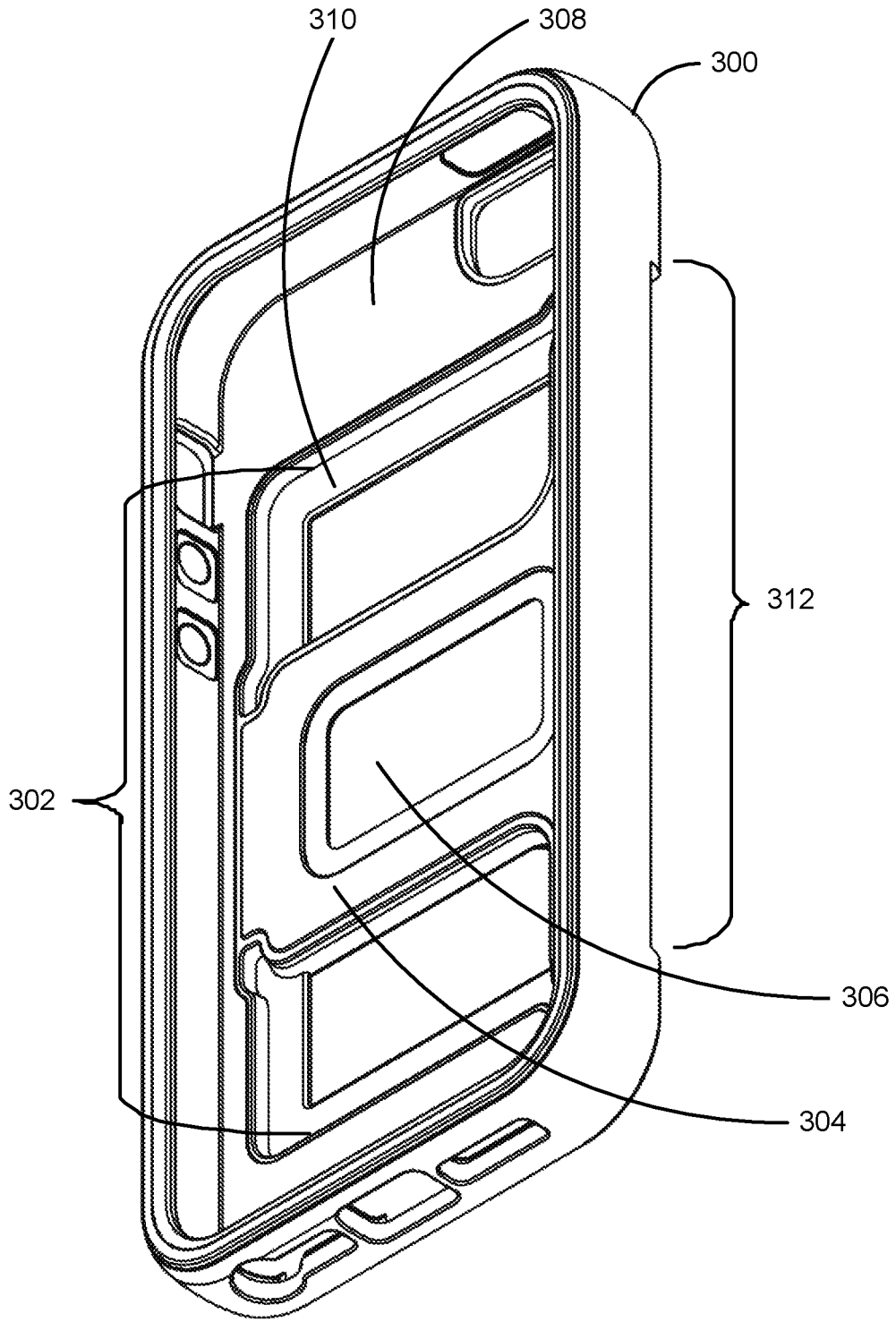
FIG. 3 is a front perspective view of a mobile phone case in an embodiment shown without an enclosed phone and without a credit card inserted into the card holder embedded into the back of the case, in accordance with an aspect of the present invention.

FIG. 3 presents a front perspective view of a mobile phone case in an embodiment shown without an enclosed phone and without a credit card extending from a card holder embedded in the back of the mobile phone case. In addition to the slot 302 recessed in the back of the mobile phone case 300 for holding a card, a retainer 304 extending over the recessed slot 302, a hole 306 or opening in the retainer, and the non-recessed areas 308 of the back of the case as shown in FIG. 2 above, note the raised edge 310 on the recessed surface of the interior back of the case bordering both sides and the rear of the recessed slot. The surface area of the raised edge at the rear of the recessed slot opposite the surface area of the retainer at the rear of the recessed slot may form a flexural binder that flexes the card widthwise and lengthwise to hold the card in place. In an embodiment, there may be a tight tolerance in manufacture of the mobile phone case to provide a sufficiently uniform space between the surface area of the raised edges bordering the sides and the rear of the recessed slot and the opposite surface area of the retainer such that the card may flex widthwise and lengthwise as it is inserted between the two opposite surface areas functioning as a flexural binder to hold the card from falling out of the recessed slot.

When a card being inserted into the slot impinges against the raised edge bordering the rear of the recessed slot, an audible click may be generated as the card snaps above that raised edge and is fully inserted into the recessed slot. In addition, tactile feedback may be felt both when a card being inserted into the recessed slot impinges against that raised edge and also when the card hits the back side of the recessed slot upon complete insertion. Advantageously, the audible click and tactile feedback each provide confirmation to the person who inserted the card into the card holder that the card is fully seated and secured in slot. In an embodiment, the raised edge may extended about $1/16^{th}$ to 3/16th of an inch on the recessed surface of the interior back of the case bordering both sides and the rear of the recessed slot. Those skilled in the art will appreciate that the raised edge may function at different extensions less than 1/16th and more than 3/16ths of an inch. In various embodiments, a raised edge may additionally extend on the surface of the rear edge of retainer.

Figure 4:
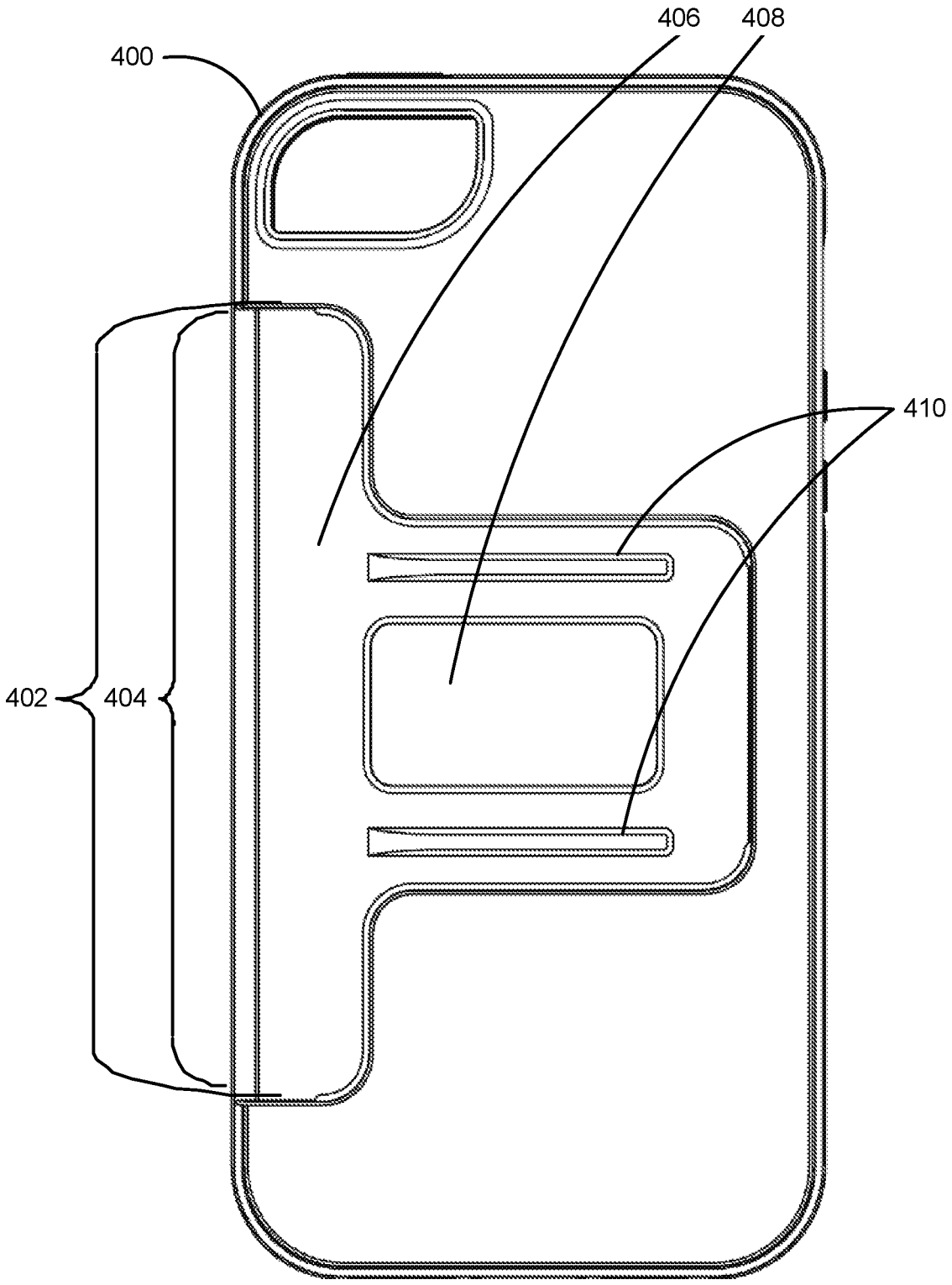
FIG. 4 is a back view of a mobile phone case in an embodiment shown without an enclosed phone and without a credit card inserted into the card holder embedded into the back of the case, in accordance with an aspect of the present invention.

FIG. 4 presents a back view of a mobile phone case in an embodiment shown without an enclosed phone and without a credit card inserted into the card holder embedded into the back of the case. As described above in conjunction with FIG. 2 and FIG. 3, the card holder embedded into the back of the mobile phone case 400 includes a slot 402 recessed in the back of the case for holding the card, an opening 404 to the recessed slot 402 on the side of the case that may continue around the corner of the case and extends over the recessed area of the back of the case for sliding a card into and out of the recessed slot 402, and a retainer 406 extending over the recessed slot against which a card may slide as it is inserted into and removed from the recessed slot. In an embodiment, the retainer may have an opening 408 in it into which a card inserted into the recessed slot may be counter flexed when manually depressed from the back of the recessed slot, for example by the thumb of a hand. Note that the opening 404 to the recessed slot on the side of the case continues around the corner of the case and extends over the recessed area of the back of the case to facilitate card movement into and out of the recessed slot from the back of the case using a thumb or finger(s) of the same hand that may be holding the mobile phone case. The opening 404 to the recessed slot that extends over the recessed area of the back of the case in particular extends over the opening 408 in the retainer 406 to allow access through the opening 404 to the recessed slot to manually depress a card over the opening 408 in the retainer 406 in order to counter flex the card into the area of the opening 408 in the retainer 406. The back of the retainer 406 in an embodiment may include rails 410 against which a card may slide during insertion into and removal from the recessed slot 402. The rails 410 may thus provide protection from scratching the magnetic stripe running across the entire length of the back of a typical credit card. When fully inserted into the recessed slot 402, a card may be flexed against the rails 410. As will be described in further detail in conjunction with FIGS. 6A, 6B and 6C below, the rails additionally facilitate flexing a card for insertion into and removal from the recessed slot 402.

In another embodiment, those skilled in the art may appreciate that there may be a detent, not shown in FIG. 4 but further described and shown in conjunction with FIG. 7 below, protruding from each side of the recessed slot 402 at the opening 404 of the recessed slot on the side of the case. A card fully inserted in the recessed slot 402 may abut each detent in order to further secure a card fully inserted in the recessed slot 402 from sliding from the recessed slot 402 unless the card is sufficiently counter flexed. In such an embodiment, the rails 410 may be raised sufficiently such that a card, fully inserted into the recessed slot 402 and flexed against the rails 410, may also abut the detents protruding at the opening 404 from each side of the recessed slot 402 and thereby be secured from sliding from the recessed slot 402 unless the card is sufficiently counter flexed. At the same time, the rails 410 may also be raised sufficiently to additionally facilitate manually counter flexing a card for removal from the recessed slot 402 such that a card, fully inserted into the recessed slot 402 and flexed against the rails 410, may be counter flexed until the edges of the sides of the card may glide over the detents when sliding the card from the recessed slot 402. Those skilled in the art will appreciate that there may be one or more raised rails 410 included on the back of the retainer.

Figure 5:
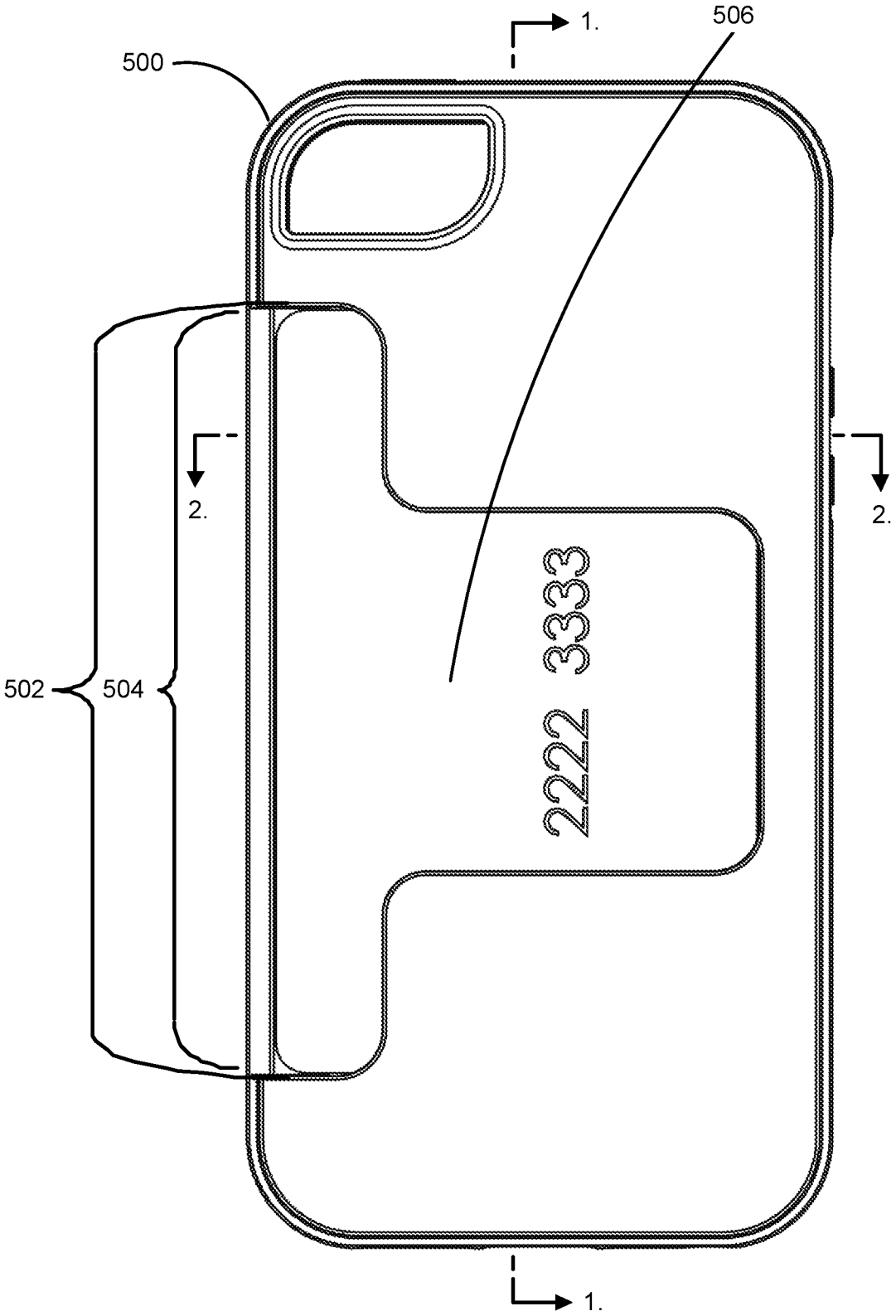
FIG. 5 is a back view of a mobile phone case in an embodiment shown without an enclosed phone and with a credit card inserted into the card holder embedded into the back of the case, in accordance with an aspect of the present invention.

FIG. 5 presents a back view of a mobile phone case in an embodiment shown without an enclosed phone and with a credit card inserted into the card holder embedded into the back of the case. The mobile phone case 500 illustrated in FIG. 5 shows a card 506 inserted into the slot 502 recessed in the back of the case through the opening 504 to the recessed slot. The opening 504 to the recessed slot only exposes partial information on the card 506, for instance, some middle digits of a credit card number. When fully inserted, a flexural binder formed from opposite-facing surfaces molded as part of the case flexes the card widthwise and lengthwise such that the forces resisting flexure exerted by the flexed card hold the card in place as described in further detail below in conjunction with FIGS. 6A, 6B and 6C.

Figure 6A:
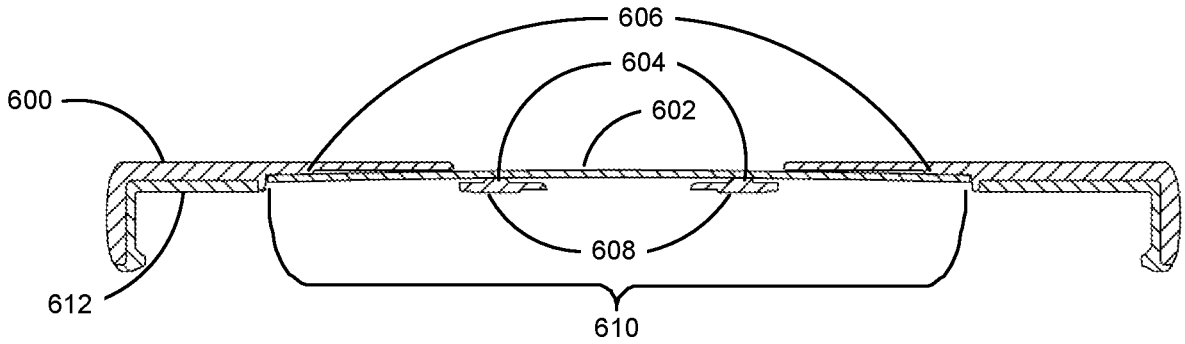
FIGS. 6A, 6B and 6C are sectional views of a mobile phone case in an embodiment shown with an enclosed phone and with a credit card at various positions in the card holder embedded into the back of the case, in accordance with an aspect of the present invention.
Figure 6B:
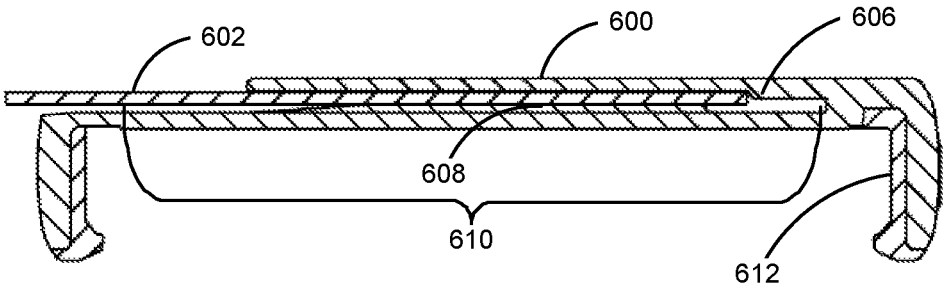
Figure 6C:
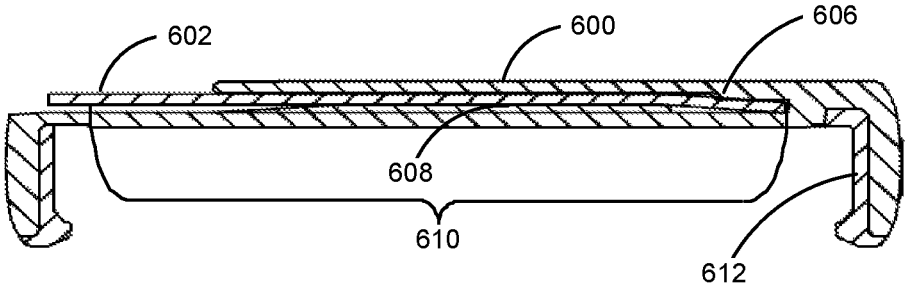

FIGS. 6A, 6B and 6C are sectional views of a mobile phone case in an embodiment shown without an enclosed phone and with a credit card at various positions in the card holder embedded into the back of the case. FIG. 6A presents a lengthwise cross sectional view taken along line 1-1 in FIG. 5 of a mobile phone case in an embodiment shown without an enclosed phone and with a credit card partially inserted into the card holder embedded into the back of the case. FIG. 6A illustrates a credit card 602 partially inserted into the slot 610 recessed in the back of the mobile phone case 600. The card may slide at each widthwise edge on the raised edges 606 molded on the interior back of the case bordering each side of the recessed slot as the opposite side of the card may glide on the rails 604 molded as part of the retainer 608. As illustrated in FIG. 6A, the height of the rails 604 molded as part of the retainer 608 may be sufficient to slightly bend the card lengthwise as the opposite widthwise sides of the card presses against the raised edges 606 molded on the interior back of the case bordering each side of the recessed slot 610. In an embodiment, the mobile phone case 600 may include a plastic liner 612 molded as part of the mobile phone case 600.

FIGS. 6B and 6C present widthwise cross sectional views taken along line 2-2 in FIG. 5 of a mobile phone case in an embodiment shown with an enclosed phone and with a credit card both partially and fully inserted into the card holder embedded into the back of the case. In particular, FIG. 6B illustrates a credit card 602 partially inserted and impinging upon the raised edges 606 on the recessed surface of the interior back of the case 600 bordering the rear of the recessed slot 610. As previously described in detail in conjunction with FIG. 6A above, when the card is being inserted into the slot, it may bend lengthwise across the rails molded as part of the retainer as the opposite widthwise sides of the card press against the raised edges molded on the interior back of the case bordering each side of the recessed slot. The center of the card 602 may thus bend upward from the retainer 608 such that it may impinge upon the raised edges 606 on the recessed surface of the interior back of the case bordering the rear of the recessed slot when it is further inserted as shown in FIG. 6B.

FIG. 6C illustrates a credit card 602 fully inserted into the slot 610 recessed in the back of the case 600 and held in place from the forces resisting flexure exerted by the flexed card. To completely insert the card, the card may be manually depressed from the back of the recessed slot, for example by the thumb of a hand, and pushed until fully inserted into the slot. When so counter flexed, the amount of bend in the center of the card that impinges upon the raised edge may be reduced, thereby enabling the card to slide under the raised edges 606 on the recessed surface of the interior back of the case bordering the rear of the recessed slot. The card also bends widthwise as it slides under the raised edged 606 bordering the rear of the recessed slot.

An audible click may be generated when the card 602 snaps under the raised edges 606 and is fully inserted into the recessed slot 610. In addition, tactile feedback may also be felt by the person inserting the card both when a card 602 being inserted into the recessed slot 610 impinges against that raised edge 606 and also when the card 602 hits the back side of the recessed slot 610 upon complete insertion. As can be seen in FIG. 6C, the card bends widthwise as it slides under the raised edged 606 bordering the rear of the recessed slot. Thus the card bends lengthwise as it is inserted into the slot as illustrated in FIG. 6A, hits the raised edge as illustrated in FIG. 6B, then further bends widthwise to wedge under the raised edge until it hits the back side of the slot upon complete insertion as illustrated in FIG. 6C. Accordingly, the card is held in place by a flexural binder that flexes the card widthwise and lengthwise such that the forces resisting flexure exerted by the flexed card hold the card in place and secure the card from falling out of the recessed slot.

Figure 7:
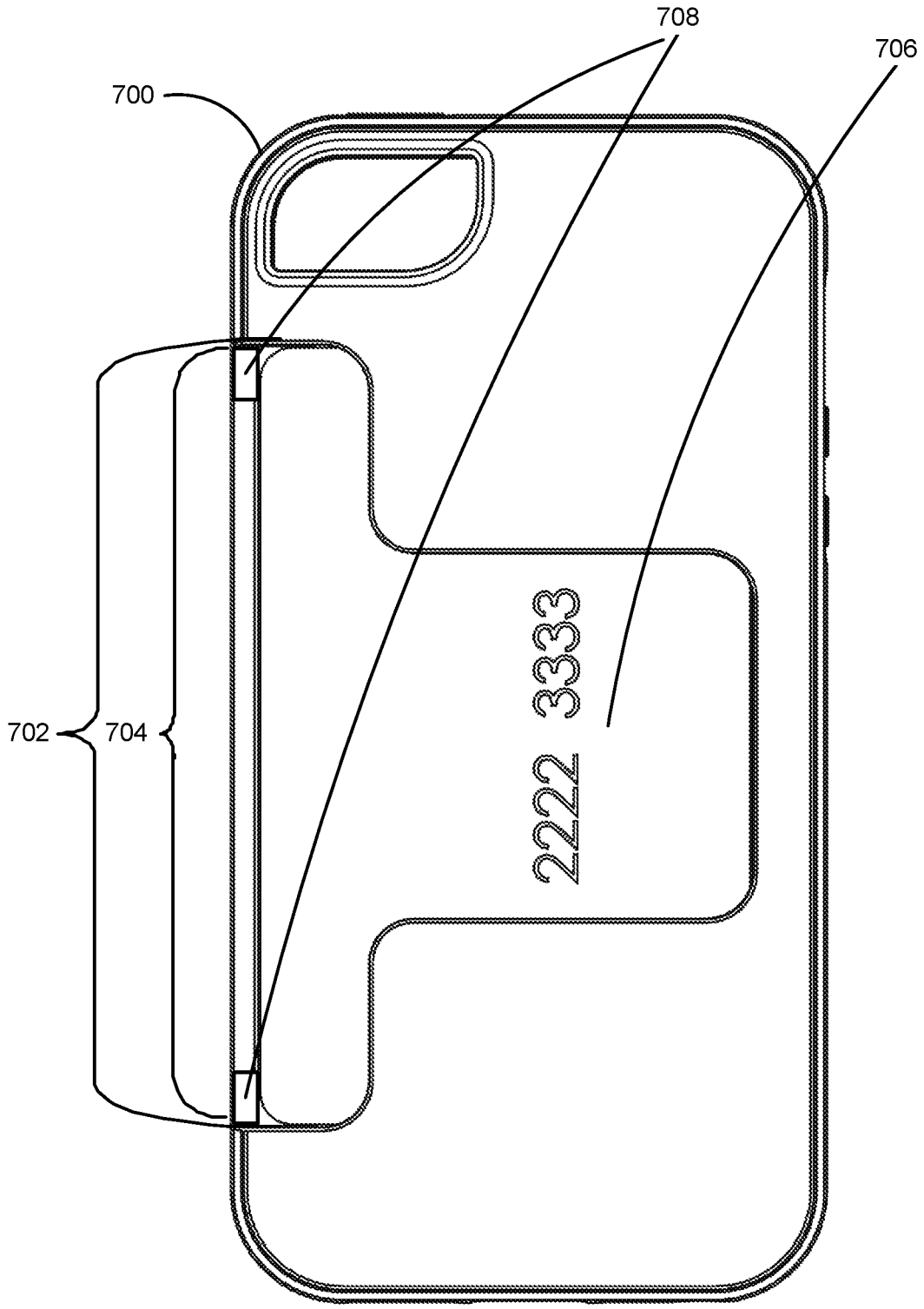
FIG. 7 is a back view of a mobile phone case in another embodiment shown without an enclosed phone and with a credit card inserted into the card holder embedded into the back of the case, in accordance with an aspect of the present invention.

FIG. 7 presents a back view of a mobile phone case in another embodiment shown without an enclosed phone and with a credit card inserted into the card holder embedded into the back of the case. The mobile phone case 700 illustrated in FIG. 7 shows a card 706 inserted into the slot 702 recessed in the back of the case through the opening 704 to the recessed slot 702. Also illustrated in FIG. 7 is a detent 708 protruding from each side of the recessed slot 702 at the opening 704 against which the card, fully inserted in the recessed slot, may abut so that the card may be secured from sliding from the recessed slot 702 unless the card 706 is sufficiently counter flexed. When the card is manually inserted through the opening 704 to the recessed slot 702, the card 706 may be manually depressed in an embodiment to counter flex the card 706 to allow the edges of the sides of the card 706 to glide over the detents 708 protruding from the sides of the recessed slot 702 at the opening 704 to the recessed slot 702. When fully inserted into the recessed slot 702, the flexed card may abut the detent 708 protruding from each side of the recessed slot 702 at the opening 704 and may not slide from the recessed slot 702 until the card 706 is sufficiently counter flexed to allow the edges of the sides of the card 706 to glide over the detents 708. Those skilled in the art will also appreciate in various embodiments that there may be one or more detents protruding from a single side of the recessed slot at the opening which may further secure a card in the recessed slot. Furthermore those skilled in the art will also appreciate, in yet other embodiments, that there may be one or more detents protruding from each side of the recessed slot at the opening which may further secure a card in the recessed slot.

Importantly, the mobile device case of the present invention conveniently allows a consumer to partially extend a credit card from the embedded card holder using the thumb or finger(s) of one hand holding the phone to expose and swipe the magnetic stripe on the back of the card through a point of sale card reader. As can be seen from the foregoing detailed description, the present invention provides a mobile device case that may conveniently carry and access a credit card, a payment card, a proximity card, a smart card, a business card or other card that may have a magnetic stripe, radio frequency identification or other communication interface for reading or transmitting information stored on the card such as financial, identification, medical or other data. Such cards may be easily accessed, secured from inadvertently falling out of the case, and protected from scratching when inserted into and removed from the embedded card holder. Moreover, the mobile device may also be protected from scratching during insertion into and removal of the card from the embedded card holder. As a result, the mobile device case with the embedded card holder provides significant advantages and benefits needed for consumers who carry a card in their mobile device case.

While the invention is susceptible to various modifications and alternative constructions, certain illustrated embodiments thereof are shown in the drawings and have been described above in detail. It should be understood, however, that there is no intention to limit the invention to the specific forms disclosed, but on the contrary, the intention is to cover all modifications, alternative constructions, and equivalents falling within the spirit and scope of the invention.

What is claimed is:

1. A case for a mobile phone, comprising:

a one-piece molded case that encloses the mobile phone, the case having a card slot recessed into a back of the case with an area in the card slot fitted for insertion of a credit card;

an opening of the one-piece molded case sized for sliding the credit card into the card slot recessed into the back of the case with the area in the card slot fitted for insertion of the credit card;

a retainer of the one-piece molded case extending from a non-recessed portion of the back of the case over the card slot recessed into the back of the case with the area in the card slot fitted for insertion of the credit card;

a raised edge of the one-piece molded case protruding from an interior surface of the card slot recessed into the back of the case, the raised edge bordering on each side wall and a back side wall of the card slot recessed into the back of the case; and at least one detent positioned at the opening sized for sliding the credit card into the card slot recessed into the back of the case and in front of the area in the card slot fitted for insertion of the credit card.

2. The case of claim 1 further comprising a hole in the retainer that provides a space for flexing the credit card when manually depressed whereby at least one edge of the credit card bends above the at least one detent.

3. The case of claim 1 wherein the retainer extending from the non-recessed portion of the back of the case over the card slot recessed into the back of the case further comprising at least one rail situated on a surface of the retainer facing the opening for insertion of the credit card into the card slot recessed into the back of the case.

4. A case for a mobile phone, comprising:

a one-piece molded case that encloses the mobile phone, the case having a card slot recessed into a back of the case with an area in the card slot fitted for insertion of a card;

an opening of the one-piece molded case sized for sliding the card into the card slot recessed into the back of the case with the area in the card slot fitted for insertion of the card;

a retainer of the one-piece molded case extending from a non-recessed portion of the back of the case over the card slot recessed into the back of the case with the area in the card slot fitted for insertion of the card;

a raised edge of the one-piece molded case protruding from an interior surface of the card slot recessed into the back of the case, the raised edge bordering on each side wall and a back side wall of the card slot recessed into the back of the case; and at least one detent positioned at the opening sized for sliding the card into the card slot recessed into the back of the case and in front of the area in the card slot fitted for insertion of the card.

5. The case of claim 4 further comprising a hole in the retainer that provides a space into which a center portion of the card flexes when manually depressed whereby at least one edge of the card bends above the at least one detent.

6. The case of claim 4 wherein the retainer extending from the non-recessed portion of the back of the case over the card slot recessed into the back of the case further comprising at least one rail situated on a surface of the retainer facing the opening for insertion of the card into the card slot recessed into the back of the case.

7. The case of claim 4 wherein the card slot recessed into the back of the case with the area in the card slot fitted for insertion of the card comprises a card slot recessed into a back of the case with an area in the card slot fitted for insertion of a business card; and wherein the opening sized for sliding the card into the card slot recessed into the back of the case with the area in the card slot fitted for insertion of the card comprises an opening sized for sliding the business card into the card slot recessed into the back of the case with the area in the card slot fitted for insertion of the business card.

8. The case of claim 4 wherein the card slot recessed into the back of the case with the area in the card slot fitted for insertion of the card comprises a card slot recessed into a back of the case with an area in the card slot fitted for insertion of a payment card; and wherein the opening sized for sliding the card into the card slot recessed into the back of the case with the area in the card slot fitted for insertion of the card comprises an opening sized for sliding the payment card into the card slot recessed into the back of the case with the area in the card slot fitted for insertion of the payment card.

9. The case of claim 4 wherein the card slot recessed into the back of the case with the area in the card slot fitted for insertion of the card comprises a card slot recessed into a back of the case with an area in the card slot fitted for insertion of an identification card; and wherein the opening sized for sliding the card into the card slot recessed into the back of the case with the area in the card slot fitted for insertion of the card comprises an opening sized for sliding the identification card into the card slot recessed into the back of the case with the area in the card slot fitted for insertion of the identification card.

10. The case of claim 4 wherein the card slot recessed into the back of the case with the area in the card slot fitted for insertion of the card comprises a card slot recessed into a back of the case with an area in the card slot fitted for insertion of a proximity card; and wherein the opening sized for sliding the card into the card slot recessed into the back of the case with the area in the card slot fitted for insertion of the card comprises an opening sized for sliding the proximity card into the card slot recessed into the back of the case with the area in the card slot fitted for insertion of the proximity card.

* * * * *